United States Patent [19]

Isomura et al.

[11] Patent Number: 4,461,261

[45] Date of Patent: Jul. 24, 1984

[54] CLOSED LOOP AIR/FUEL RATIO CONTROL USING LEARNING DATA EACH ARRANGED NOT TO EXCEED A PREDETERMINED VALUE

[75] Inventors: Shigenori Isomura; Toshio Kondo; Yasumasa Kaji; Akio Kobayashi, all of Kariya, Japan

[73] Assignee: Nippondenso Co., Ltd., Kariya, Japan

[21] Appl. No.: 377,542

[22] Filed: May 12, 1982

[30] Foreign Application Priority Data

May 18, 1981 [JP] Japan ..... 56-75297

[51] Int. Cl.[3] ..... F02D 5/00

[52] U.S. Cl. ..... 123/489; 123/480; 123/486

[58] Field of Search ..... 123/489, 440, 486, 480, 123/589

[56] References Cited

U.S. PATENT DOCUMENTS

| | | | |
|---|---|---|---|
| 3,874,171 | 4/1975 | Schmidt et al. | 123/440 |
| 4,235,204 | 11/1980 | Rice | 123/489 |
| 4,265,208 | 5/1981 | Emmert et al. | 123/440 |
| 4,319,451 | 3/1982 | Tajima et al. | 60/274 |
| 4,321,903 | 3/1982 | Kondo et al. | 123/440 |
| 4,345,561 | 8/1982 | Kondo et al. | 123/440 |
| 4,348,727 | 9/1982 | Kobayashi et al. | 364/431.06 |
| 4,348,728 | 9/1982 | Sagisaka et al. | 123/489 |
| 4,355,616 | 10/1982 | Tamura et al. | 123/489 |
| 4,365,299 | 12/1982 | Kondo et al. | 123/489 |

FOREIGN PATENT DOCUMENTS 55-134731 10/1980 Japan .

*Primary Examiner*—Andrew M. Dolinar

*Attorney, Agent, or Firm*—Cushman, Darby & Cushman

[57] ABSTRACT

In a closed loop control system for air/fuel ratio control of an internal combustion engine, an integration correction factor is derived from the output signal of a gas sensor indicative of the concentration of an exhaust gas component, and an engine condition correction factor is selected from a memory in which a plurality of engine condition correction factors are prestored in the form of a table. The engine condition correction factor is renewed in accordance with the variation in the value of the integration correction factor so as to perform learning control. In order to prevent each of the engine condition correction factors from assuming an undesirable value which are far deviated from its standard, a constant or variable limit value is set. The limit value may be set by calculating some typical engine condition correction factors. The correction factors will be used to modify a basic quantity of fuel to be injected into each cylinder of the engine for feedback controlling the air/fuel ratio of the air/fuel mixture.

12 Claims, 14 Drawing Figures

| SUBRANGE NO. | 1 | 2 | --- | --- | n-1 | n | n+1 | --- | --- | 15 | 16 |
|---|---|---|---|---|---|---|---|---|---|---|---|
| THIRD CORRECTION FACTOR $K_3$ | $K_3^1$ | $K_3^2$ | --- | --- | $K_3^{n-1}$ | $K_3^n$ | $K_3^{n+1}$ | --- | --- | $K_3^{15}$ | $K_3^{16}$ |

CLOSED LOOP AIR/FUEL RATIO CONTROL USING LEARNING DATA EACH ARRANGED NOT TO EXCEED A PREDETERMINED VALUE

BACKGROUND OF THE INVENTION

This invention relates generally to closed loop air/fuel ratio control of an internal combustion engine mounted on a motor vehicle or the like, and more particularly, the present invention relates to a method and apparatus for controlling the air/fuel ratio in response to a signal derived from an exhaust gas sensor to reduce the emission of noxious components in burnt gases.

Various methods and systems for effecting air/fuel ratio control are known, and in one conventional method, an integration corrective setting or correction factor is derived by integrating the output signal from the gas sensor, and then another corrective setting or correction factor is derived in accordance with the integration correction factor and the operating condition of the engine. The second-mentioned correction factor, which will be referred to as an engine condition correction factor or amount, is stored in a memory so that feedback control will be effected by determining the air/fuel ratio supplied to the engine by correcting or modifying a basic fuel flow amount, which is derived on the basis of the intake airflow and the engine speed, by these correction factors. In such a known system, in which so called learning control or correction is effected, the engine condition correction factor is apt to assume a value far deviated from its standard value due to some reasons. For instance, in an automotive engine, fuel vapor adsorbing and supplying system including a canister is provided to supply the engine with fuel vapor evaporated in the fuel tank. Because of such a system, a rich mixture is apt to be fed to the engine irrespective of the learning control, causing the engine condition correction factor or factors to assume undesirable values which are far deviated from their standard values.

If the engine is stopped under such condition, the data for the engine condition correction factors remain in the memory. Therefore, when the engine is restarted after being cooled, the engine condition correction factors, whose values are far deviated from their standard values, will be used to erroneously control the air/fuel ratio resulting in undesirable operation of the engine and emission of noxious components.

SUMMARY OF THE INVENTION

The present invention has been developed in order to remove the above-described drawbacks inherent to the conventional closed loop air/fuel ratio control in which learning control is effected.

It is, therefore, an object of the present invention to provide a method and apparatus for controlling air/fuel ratio of an air/fuel mixture supplied to an internal combustion engine so that rich mixture due to fuel vapor from the canister does not result in undesirable operation of the engine.

According to a feature of the present invention, a predetermined limit, which may be either constant or variable in accordance with the engine operational conditons, is provided to the engine condition correcting factors. The limit value may be derived by processing typical engine condition correcting factors corresponding to predetermined engine operational conditions.

In accordance with the present invention there is provided a method for controlling air/fuel ratio in an internal combustion engine equipped with a closed loop control system which controls the air/fuel ratio in accordance with an output signal of a sensor detecting the air/fuel ratio, comprising the steps of: integrating said ouput signal from said sensor for obtaining an integration correction factor; detecting the operational condition of said engine; renewing an engine condition correction factor read out from a memory, in which a plurality of engine condition correction factors are prestored, by using said integration correction factor where one of said engine condition correction factors corresponding to the operational condition of said engine is renewed; limiting the value of said engine condition correction factors so as not to exceed a predetermined value; and controlling the air/fuel ratio by correcting a standard value, which is obtained on the basis of the operational parameters of said engine, by said integration correction factor and said engine condition correction factor selectively read out from said memory in accordance with the engine operational condition.

In accordance with the present invention there is also provided apparatus for controlling air/fuel ratio in an internal combustion engine equipped with a closed loop control system which controls the air/fuel ratio in accordance with an output signal of a sensor detecting the air/fuel ratio, comprising: first means for detecting the operational condition of said engine; and second means for processing said output signal from said sensor for obtaining a correction factor; for renewing an engine condition correction factor read out from a memory, in which a plurality of engine condition correction factors are prestored, by using said first-mentioned correction factor where one of said engine condition correction factors corresponding to the operational condition of said engine is renewed; for limiting the value of said engine condition correction factors so as not to exceed a predetermined value; and for controlling the air/fuel ratio by correcting a standard value, which is obtained on the basis of the operational parameters of said engine, by both said first-mentioned correction factor and said engine condition correction factor selectively read out from said memory in accordance with the engine operational condition.

BRIEF DESCRIPTION OF THE DRAWINGS

The object and features of the present invention will become more readily apparent from the following detailed description of the preferred embodiments taken in conjunction with the accompanying drawings in which.

The same or corresponding elements and parts are designated at like reference numerals throughout the drawings.

DETAILED DESCRIPTION OF THE PREFERRED EMBODIMENTS

Figure 1:
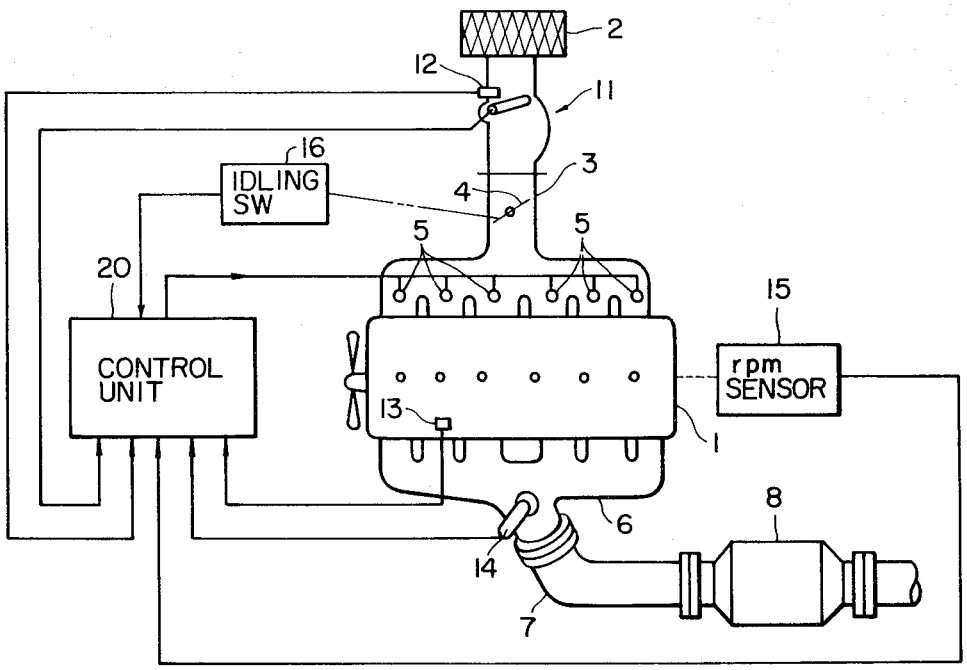
FIG. 1 is a schematic diagrm of an air/fuel ratio control system according to the present invention.

FIG. 1 illustrates a closed loop or feedback air/fuel ratio control system of an internal combustion engine mounted on an automotive vehicle. An internal combustion engine 1, which functions as the prime mover of an automotive vehicle (not shown), is of well known 4-cycle spark ignition type. The engine 1 is arranged to be supplied with air via an air cleaner 2, an intake manifold 3 and a throttle valve 4. The engine 1 is also supplied with fuel, such as gasoline, from an unshown fuel tank. The fuel from the fuel tank is fed through an unshown fuel supplying system to fuel injection valves 5, which are electromagnetically operable. The fuel injection valves 5 are provided for respective cylinders of the engine 1 in the conventional manner. Exhaust gasses produced as the result of combustion are discharged in atmosphere through an exhaust manifold 6, an exhaust pipe 7 and a three-way catalytic converter 8.

The intake manifold 3 is equipped with an airflow meter 11 constructed of a movable flap and potentiometer, the movable contact of which is operatively connected to the flap. The airflow meter 11 is equipped with a thermister type temperature sensor 12 for producing an output analog signal indicative of the temperature of the intake air. A second thermister type temperature sensor 13 is shown to be coupled to the engine 1 for producing an output analog signal indicative of the coolant temperature.

An oxygen sensor 14, which functions as an air/fuel ratio or gas sensor, is disposed in the exhaust manifold 6 for producing an output signal indicative of the concentration of the oxygen contained in the exhaust gasses. As is well known, the oxygen concentration represents the air/fuel ratio of the air/fuel mixture suplied to the engine 1, and for instance, the output voltage of the oxygen sensor 14 is approximately 1 volt when the detected air/fuel ratio is smaller, i.e. richer than the stoichiometric air/fuel ratio; and is approximately 0.1 volt when the detected air/fuel ratio is higher, i.e. leaner, than the same. Accordingly, the gas sensor output can be treated as a digital signal.

An engine speed sensor 15 is employed for detecting the engine rpm. Namely, the rotational speed of the engine crankshaft (not shown) is indicated by the number of pulses produced per unit time. Such a pulse train signal, i.e. rotation synchronized signal, may be readily derived from the primary winding of the ignition coil of the ignition system (not shown).

An idling switch is provided to detect when the throttle valve 4 is fully closed. Namely, the idling switch 16 functions as a throttle valve position sensor to produce an output signal when the throttle valve 4 is fully closed.

The output signals of the above-mentioned circuits, namely the airflow meter 11, the intake air temperature sensor 12, the coolant temperature sensor 13, the oxygen sensor 14, the speed (rpm) sensor 15, and the idling switch 16 are respectively applied to a control unit 20 which may be constructed of a microcomputer system.

The control unit 20 determines the energizing period of the fuel injection valves 5 in accordance with various information applied thereto so that desired air/fuel ratio can be ensured.

Figure 2:
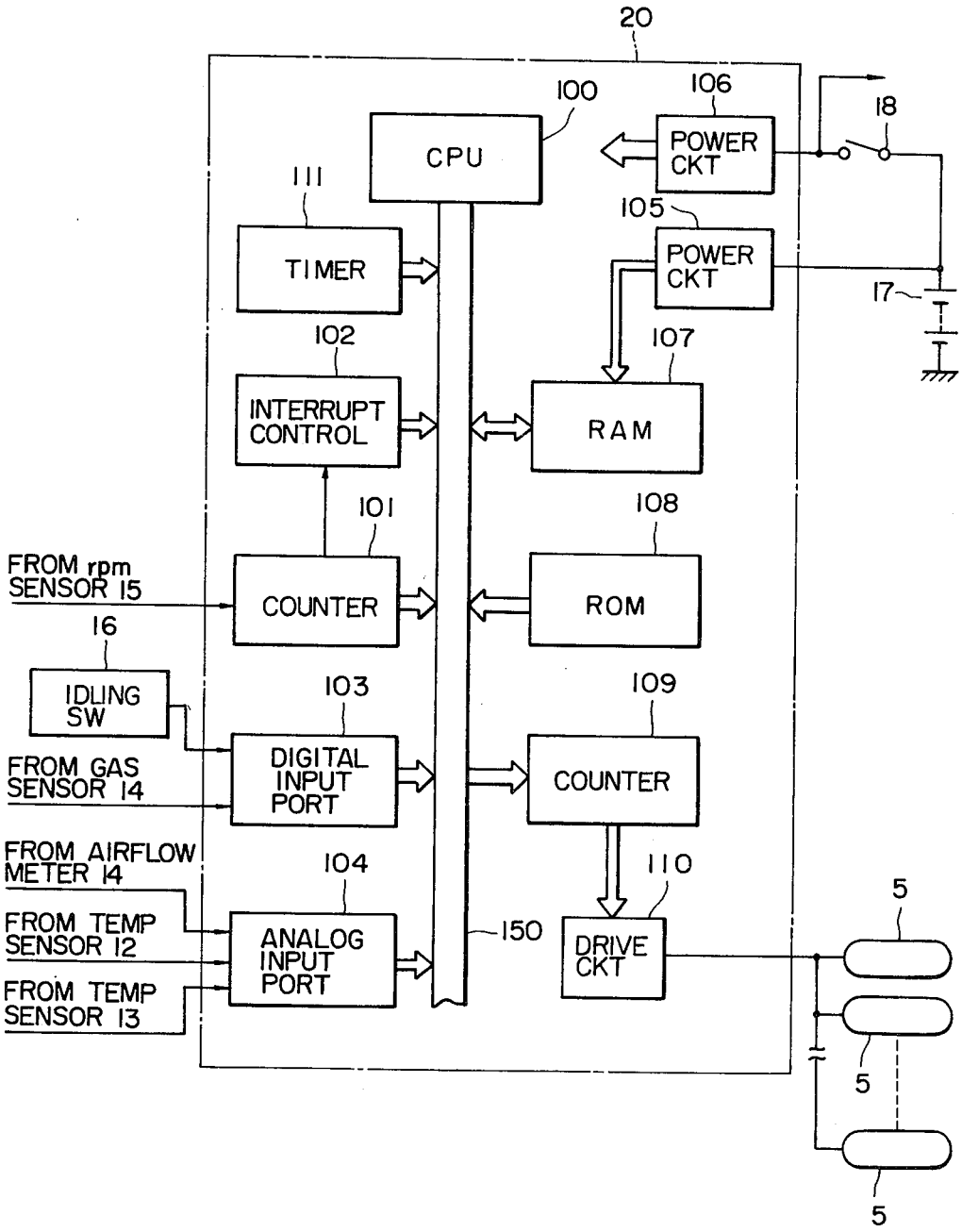
FIG. 2 is a schematic block diagram of the control unit shown in FIG. 1.

FIG. 2 illustrates a detailed block diagram of the control unit 20 shown in FIG. 1. The control unit 20 comprises a microprocessor, i.e. a central processing unit 100 (CPU), for calculating the quantity of fuel to be supplied to the engine 1 in accordance with various information applied thereto. A counter 101 for measuring the number of rotations of the engine crankshaft is responsive to the output signal of the above-mentioned speed sensor 15 to count the number of clock pulses. The counter 101 has first and second outputs respectively connected to a common bus 150 and to an input of an interrupt control unit 102 the output of which is connected to the common bus 150. With this arrangement the counter 101 is capable of supplying the interrupt control unit 102 with an interrupt instruction. In receipt of such an instrtuction the interrupt control unit 102 produces an interrupt signal which is fed to the CPU 100 via the common bus 150.

A digital input port 103 is provided for receiving digital signals from the air/fuel ratio sensor 14 and from the idling switch 16. These digital signals are applied via the common bus 150 to the CPU 100. An analog input port 104, which is constructed of an analog multiplexer and an A/D converter, is used to convert analog signals from the airflow meter 11, the intake air temperature sensor 12, and from the coolant temperature sensor 13 in a sequence, and then to deliver the converted signals via the common bus 150 to the CPU 100.

A first power supply circuit 105 receives electric power from a power source 17, such as a battery mounted on the motor vehicle. This first power supply circuit 105 supplies a RAM 107, which will be described hereinlater, with electrical power, and is directly connected to the power source 17 rather than through a switch. A second power supply circuit 106 is, however, connected to the power source 17 via a switch 18, which may be an ignition key or a switch controlled by the ignition key. The second power supply circuit 106 supplies all of the circuits included in the control unit 20 except for the RAM 107.

The RAM 107 is used to temporarily store various data during the operations of the CPU 100. Since the RAM 107 is continuously fed with electrical power from the power source 17 through the first power supply circuit 105, the data stored in the RAM 107 are not erased or cancelled although the ignition key 18 is turned off to stop the engine operation. Namely, this RAM 107 can be regarded as a nonvolatile memory. Data indicative of second correction factors $K_2$, which will be described later, will be stored in the RAM 107. The RAM 107 is coupled via the common bus 150 to the CPU 100 so that various data will be written in and read out from the RAM 107 as will be described hereinlater.

A read-only memory (ROM) 108 is connected via the common bus 150 to the CPU 100 for supplying the same with an operational program and various constants. As is well known, the data or information contained in the ROM 108 has been prestored therein in nonerasable form when manufacturing.

A counter 109 including a down counter and registers is provided for producing pulse signals, width of which corresponds to the quantity of fuel to be supplied to the engine 1. The counter 109 is coupled via the common bus 150 to the CPU 100 for receiving digital signals indicative of the quantity of fuel which should be fed to the engine 1. Namely, the counter 109 converts its digital input into a pulse train signal, the width of which is varies by the digital input, so that fuel injection valves 5 are successively energized for an interval defined by the pulse width to inject fuel into each port of the intake manifold 3. The pulse train signal produced in the counter 109 is then applied to a driving stage 110 for producing a driving current with which the fuel injection valves 5 are energized successively.

A timer circuit 111 is connected via the common bus 150 to the CPU 100 for supplying the same with information of laps of time measured. Namely, the timer circuit 111 comprises a clock generator for supplying the CPU 100 with clock pulses, and a counter for counting the number of clock pulses to indicate the laps of time.

The counter 101 measures the engine speed haft once per a revolution of the engine crankshaft by counting the number of clock pulses in response to the pulses from the engine rotational speed sensor 15. The aforementioned interrupt instruction is produced by the counter 101 at the end of each measurement of the engine speed. In response to the interrupt instruction the interrupt control unit 102 produces an interrupt signal as described in the above so that the running program temporarily stops to execute an interrupt routine.

Figure 3:
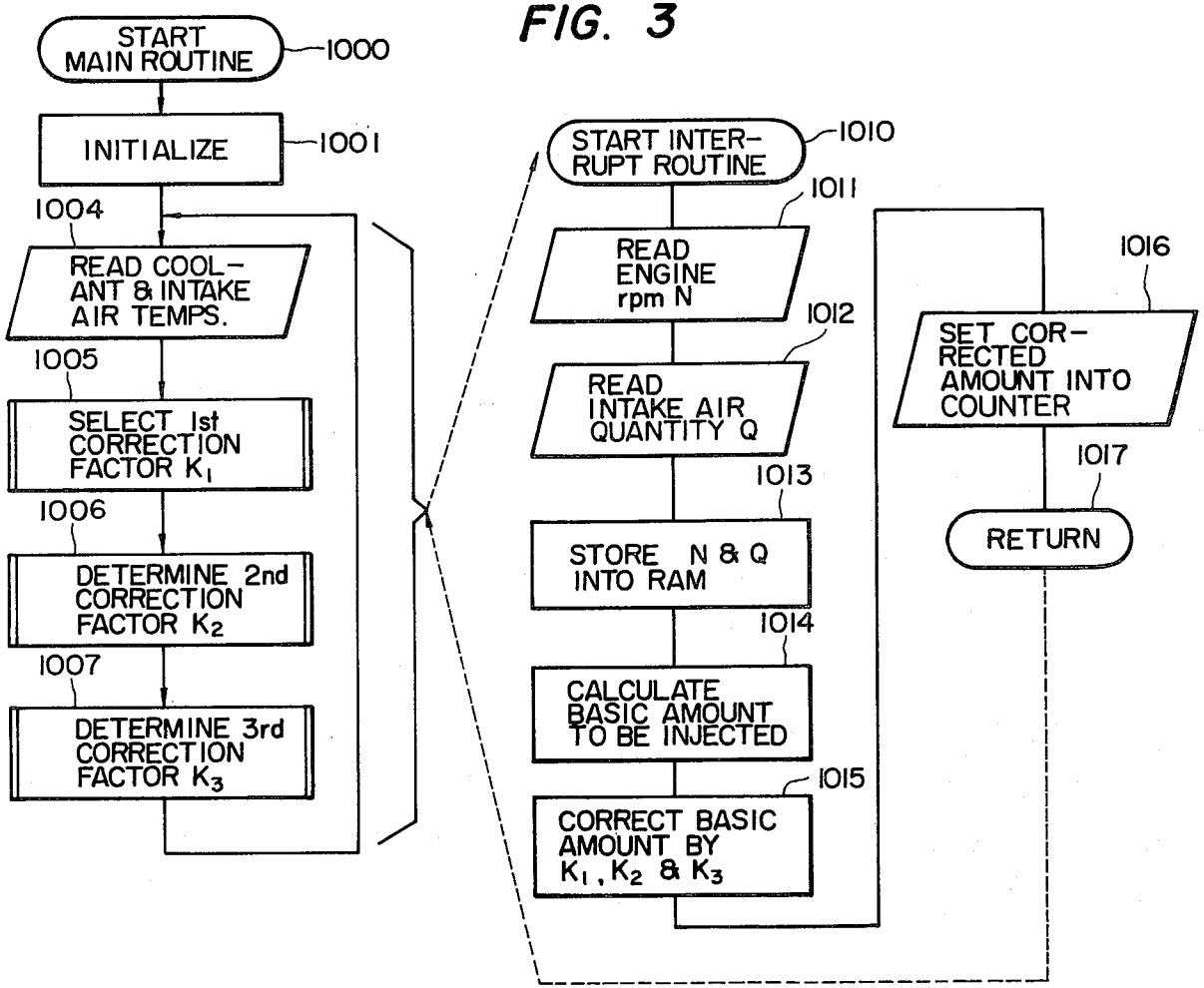
FIG. 3 is a flowchart showing the operational steps of the central processing unit shown in FIG. 2.

FIG. 3 is a flowchart showing brief operational steps of the CPU 100, and the function of the CPU 100 as well as the operation of the system of FIG. 2 will be described with reference to this flowchart. The engine 1 starts running when the ignition key 18 is turned on. The control unit 20 is thus energized to start the operational sequence from its starting step 1000. Namely, the main routine of the program will be executed. In a following step 1001, initialization is performed, then in a following step 1004, digital data of the coolant temperature and the intake air temperature applied from the analog input port 104 is stored. Then in a following step 1005, a first correction factor $K_1$ is obtained on the basis of the above-mentioned data, and this first correction factor $K_1$ will be stored in RAM 107.

The above-mentioned first correction factor $K_1$ may be obtained, for instance, by selecting one value, in accordance with the coolant and intake air temperature, from a plurality of values prestored in the ROM 108 in the form of a map. If desired, however, the first correction factor $K_1$ may be obtained by solving a given formula with the above-mentioned data substituted. In a following step 1006, the output signal of the air/fuel ratio sensor 14 applied through the digital input port 103 is read, and a second correction factor $K_2$, which will be referred to as an integration correction factor and will be described hereinlater, is either increased or decreased as a function of time measured by the timer 111. The second correction factor $K_2$ indicates a result of integration and is stored in the RAM 107.

Figure 4:
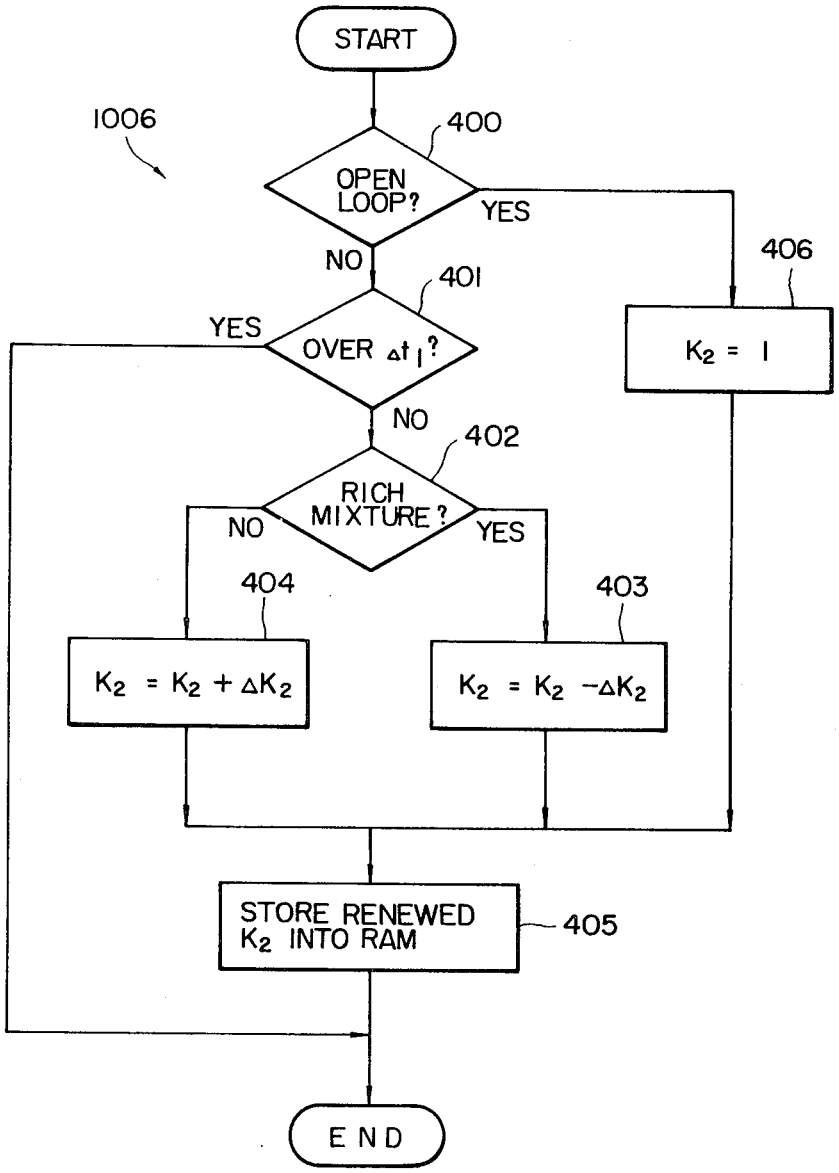
FIG. 4 is a detailed flowchart of the step for processing a second correction factor (integration correction factor), which step is shown in FIG. 3.

FIG. 4 is a flowchart showing detailed steps included in the step 1006 of FIG. 3, which steps are used to either increase or decrease, i.e. to integrate, the second correction factor $K_2$. In a step 400, it is detected whether the feedback control system is in an open loop condition or in a closed loop condition. In order to detect such a state of the feedback control system, it is detected whether the air/fuel ratio sensor 14 is active or not. This step 400, however, may be replaced with a step of detecting whether the coolant temperature or the like is above a given level to be able to perform a feedback control. When a feedback 9 control cannot be performed, i.e. when the feedback control system is in an open loop condition, a following step 406 takes place to set as $K_2=1$, then entering into a following step 405.

On the other hand, when a feedback control can be performed, a step 401 takes place to detect whether the lapse of time measured has exceeded unit time $\Delta t_1$. If the answer of the step 401 is NO, the operation of the step 1006 terminates. If the answer of this step 401 is YES, i.e. when the measured lapse of time has exceeded the unit time $\Delta t_1$, a following step 402 takes place to see whether the output signal of the air/fuel ratio sensor 14 indicates that the air/fuel mixture is rich or not. Assuming that a high level output signal of the air/fuel ratio sensor 14 indicates a rich mixture, when such a high level output signal is detected, the program enters into a step 403 in which the value of $K_2$, which has been obtained in the prior cycle, is reduced by $\Delta K_2$. On the contrary, when the air/fuel mixture is detected to be lean, namely when the output signal of the air/fuel ratio sensor 14 is low, a step 404 takes place to increase the value of $K_2$ by $\Delta K_2$. After the value of $K_2$ is either increased or decresed as mentioned in the above, the aforementioned step 405 takes place to store the renewed value of $K_2$ into the RAM 107.

Figures 6, 7:
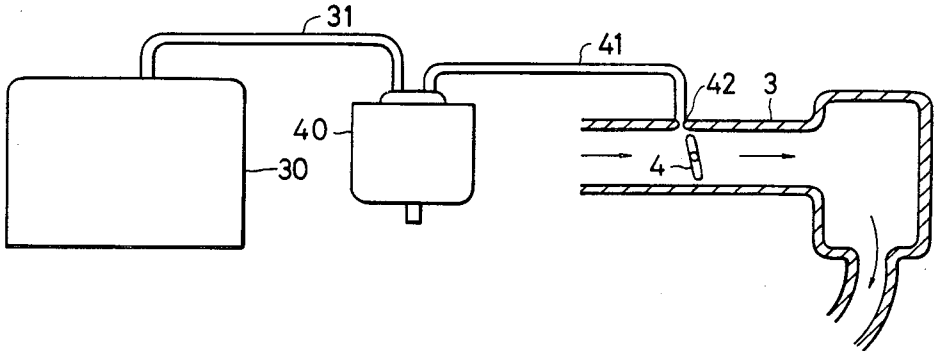
FIG. 6 is a map of the third correction factor stored in the memory shown in FIG. 2.
FIG. 7 is a schematic diagram of fuel vapor adsorbing and supplying system used for the engine of FIG. 1.

Turning back to FIG. 3, a step 1007 follows the step 1006 which has been described in detail with reference to FIG. 4. In the step 1007, a third correction factor $K_3$ (engine condition correction factor) is renewed through so called learning control or correction. A plurality of values for the third correction factor $K_3$ are prestored in the RAM 107 in the form of a table as shown in FIG. 6. Namely, the entire range of the intake air quantity Q is divided into sixteen subranges 1 to 16, and each subrange is assigned by a corresponding value of the third correction factor $K_3$. In order to distinguish these values of different third correction factors $K_3$ for different subranges of the intake air Q, each third correction factor is expressed in terms of $K_3^n$. For instance, the third correction factor corresponding to the first subrange 1 corresponding to the smallest in the intake air quantity Q is expressed by $K_3^1$.

According to the present invention variation in the air/fuel ratio due to undesirable values of the third or engine condition correction factors $K_3$ which would occur by some reasons is suppressed by improving the operation in the learning control. Especially, undesirable influence which is apt to be given to the third correcion factors $K_3$ by the rich mixture caused by random supply of the fuel vapor from the canister can be satisfactorily prevented. This point will be described hereinlater in detail with reference to FIGS. 5 to 9.

Turning back to FIG. 3, it will be described how the air/fuel ratio of the mixture supplied to the engine 1 is controlled in accordance with the present invention. The operational steps 1004 to 1007 of the main routine are repeatedly executed normaly. However, when the aforementioned interrupt signal is applied to the CPU 100 from the interrupt control circuit 102, an interrupt routine also illustrated in FIG. 3 takes place. Namely, the execution of the steps of the main routine is stopped to enter into the interrupt routine even though execution of one cycle of the main routine has not yet been completed.

After the operational flow enters into the START step 1010 of the interrupt routine, a first step 1011 follows in which data indicative of the engine rpm N from the counter 101 is read. In a following step 1012, data indicative of the intake air quantity Q from the analog input port 104 is read. These data N and Q are respectively stored in the RAM 107 to calculate a basic quantity of fuel to be injected into each cylinder of the engine 1. The quantity of fuel injected into each cylinder is porportional to a period for which each of the electromagnetic injection valves 5 is made open. The basic quantity of fuel, is expressed in terms of "t", and this value of "t" is given by the following formula:

$$t=F\times N/Q$$

wherein F is a constant.

After the basic value of the opening interval "t" has been obtained in a step 1014, this basic opening interval "t" will be corrected by the above-mentioned three correction factors $K_1$, $K_2$ and $K_3$ in a following step 1015. Namely, these correction factors $K_1$, $K_2$ and $K_3$, which have been obtained and thus updated in the operations of the main routine, are read out from the RAM 107, and then a desired opening or injecting interval T will be calculated by the formula given below:

$$T=t\times K_1\times K_2\times K_3$$

The opening interval T, which has been obtained as the result of the above-mentioned calculation, is then set in the counter 109 so as to effect pulse width modulation in connection with the pulse applied to the drive circuit 110. Each of the injection valves 5 will be energized for the opening interval T in receipt of each pulse from the driving circuit 110 to inject a given quantity of fuel defined by the interval T. The interrupt routine terminates at an END step 1017 ater the completion of the step 1016 and thus the operational flow returns to the original step in the main routine where the interruption has occurred.

Although the above-described embodiment is an example of air/fuel ratio control by controlling the actuating interval of fuel injection valves of an electronic fuel injection system, the air/fuel ratio may be controlled by other ways. For instance, in an internal combustion engine equipped with a carburettor, the quantity of fuel supplied to the carburettor and/or the quantity of air bypassing the carburettor may be controlled. Furthermore, the quantity of secondary air supplied to the exhaust system of an engine may be controlled so that the concentration of a gas component included in the gasses applied to the following catalytic converter is desirably controlled as if the air/fuel ratio of the mixture supplied to the engine were controlled to a desired value.

As described in the above, since various values for the third correction factor $K_3$ are prepared in accordance with various values of the intake air quantity, a most suitable third correction factor can be instantaneously selected. As a result, it is possible to control the air/fuel ratio with a quick reponse against any engine operational conditions including a transient period. Furthermore, since the values of the third correction factors $K_3$ are automatically renewed one after another in accordance with the engine operational condition, desirable air/fuel ratio control can be ensured irrespective of the secular change of the engine and the gas sensor.

FIG. 7 shows a conventional system for adsorbing and supplying fuel vapor evaporated in the fuel tank. The system comprises a canister 40 arranged to adsorb evaporated hydrocarbons from the fuel tank 30 so that the adsorbed fuel vapor will be fed to the engine 1 in turn. In detail, the fuel vapor in the fuel tank 30 is led via a conduit 31 to the canister 40 and is adsorbed by activated charcoal (not shown). The fuel vapor adsorbed in the canister 40 is fed via another conduit 41 and a fixed orifice 42 into the intake manifold 3. As described at the beginning of this specification, the fuel vapor from the canister 40 is fed to the engine 1 irrespective of the calculated fuel quantity when engine operates in other than idling condition especially when the intake air quantity is in a midrange which includes subranges between small intake air quantity subranges and large intake air quantity subranges. Therefore, undesirable influence is apt to be given by such fuel vapor.

Figure 8:
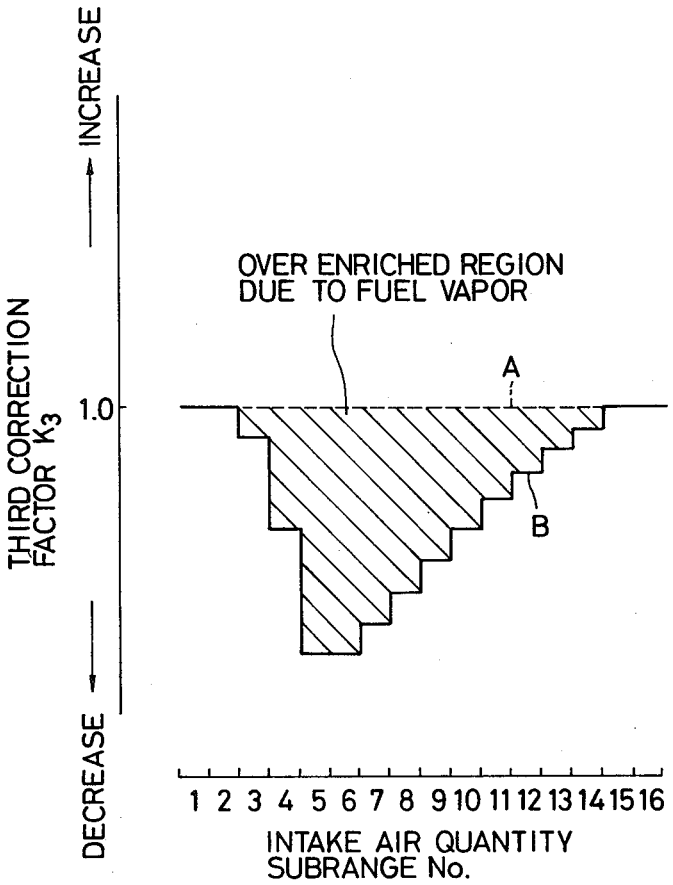
FIG. 8 is a graph showing the influence given by the fuel vapor to the third correction factor.

FIG. 8 shows the influence given to the third correction factors $K_3$ by the fuel vapor fed from the canister 40. A dotted line (A) in FIG. 8 shows the values of the third correction factor $K_3$ when no fuel vapor is supplied from the canister 40. A solid line (B) indicates the values of the third correction factors $K_3$ affected by the rich mixture caused by the fuel vapor. A hatched portion defined between the lines (A) and (B) corresponds to an over enriched region due to the fuel vapor. As will be understood from the graph of FIG. 8, the degree of over enrichment is low when the intake air quantity is either small or large. In other words, the degree of over enrichment is high when the intake air quantity assumes a midrange value.

According to the present invention, a limit value for the third correction factor $K_3$ is provided so that the value of $K_3$ is not undesirably changed by the rich mixture caused by the fuel vapor from the canister 40. In other words, the degree of influence given to the values of the third correction factor $K_3$ through the learning control due to the over enrichment caused by the fuel vapor can be minimized with the provision of such a limit value. The limit value for the third correction factor $K_3$ will be obtained by calculation by using a typical value for a small quantity of the intake air and a typical value for a large quantity of the same.

Figure 9A:
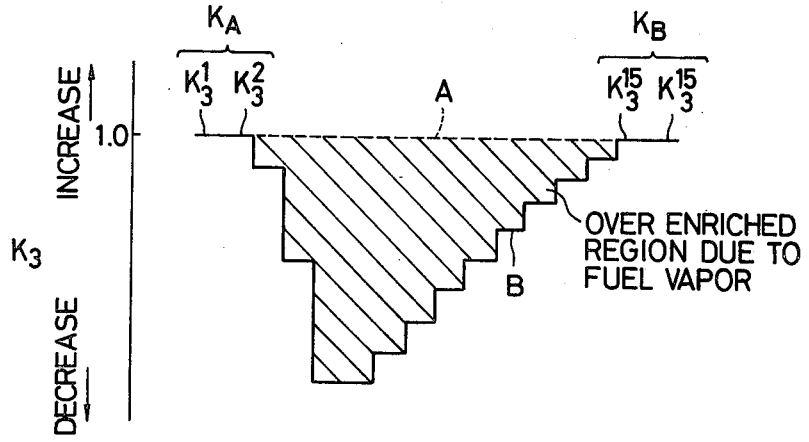
FIGS. 9A, 9B, 9C, 10A and 10B are graphs showing the way of setting the limit value of the third correction factor.
Figure 9B:
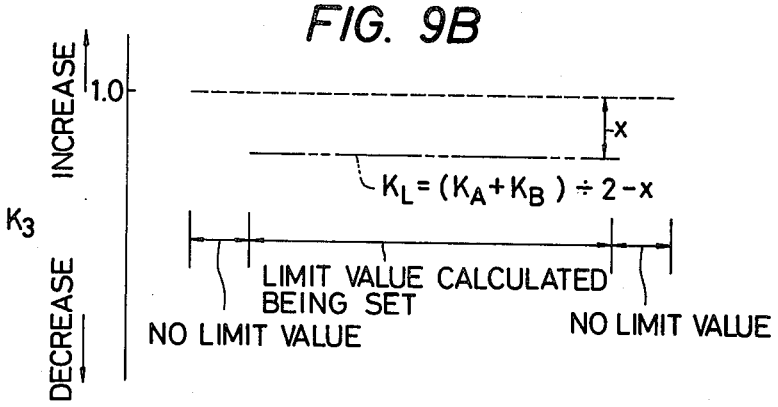

An example of calculation for obtaining the limit value of the third correction factor will be described with reference to FIGS. 9A, 9B and 9C. First of all, a typical third correction factor $K_A$ for the small intake air quantity is obtained from a following formula (1).

$$K_A=(K_3^1+K_3^2)/2 \quad (1)$$

Then another typical third correction factor $K_B$ for the large intake air quantity is obtained from a following formula (1).

$$K_B=(K_3^{15}+K_3^{16})/2 \quad (2)$$

Using the values of $K_A$ and $K_B$ obtained in the above, a limit value $K_L$ for the midrange intake air quantity is obtained by the following formula (3).

$$K_L=[(K_A+K_B)/2]-X \quad (3)$$

wherein X is a constant which is set for compensating for the variations in engine performance and parts variations, and is usually set to 3 to 5 percent.

From Eq. (3) it will be understood that the limit value $K_L$ is obtained as a mean value of $K_A$ and $K_B$, where the calculation is shown in FIG. 9B.

Figure 9C:
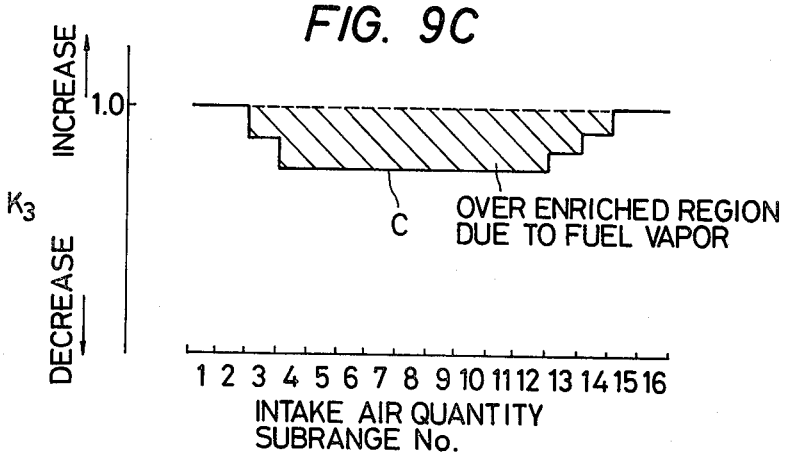

FIG. 9C shows the values of the third correction factors $K_3$ when the limit value $K_L$ has been set therefor. The limit value $K_L$ is variable and thus it will be changed each time one of the third correction factors $K_3$ corresponding to the small intake air quantity or large intake air quantity is rewritten or renewed.

Figure 5:
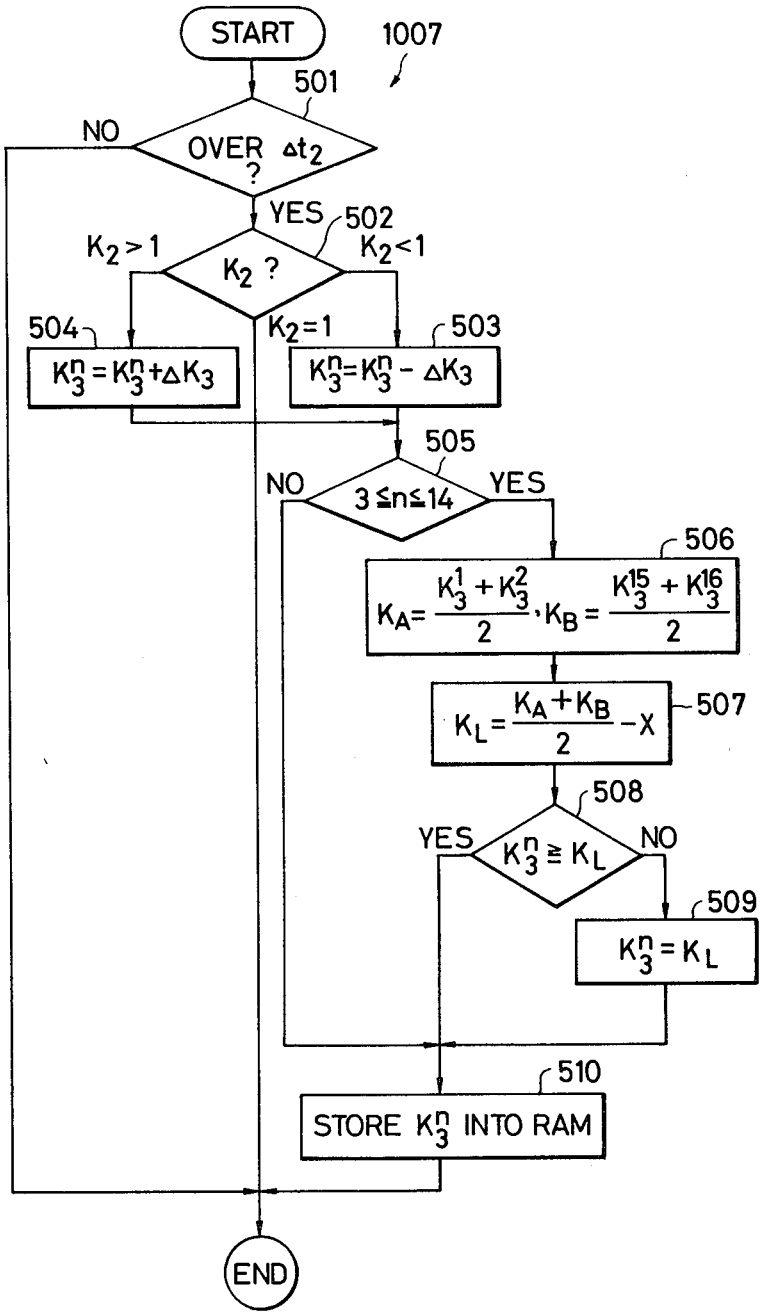
FIG. 5 is a detailed flowchart of the step for processing a third correction factor (engine operational condition correction factor), which step is also shown in FIG. 3.

A detailed flowchart of the step 1007 is shown in FIG. 5, and the operation of $K_3$ will be described with reference to FIG. 5. In a step 501, it is detected whether the lapse of time, which is measured from the instant of detection of the variation of the air/fuel ratio sensor output from one state indicative of a rich mixture to the other state indicative of a lean mixture or vice versa, has exceeded a second unit time $\Delta t_2$ or not. If the measured period has not exceeded the unit time $\Delta t_2$, the step of 1007 ends. On the other hand, if the period has exceeded, a step 502 takes place to see the value of $K_2$. If $K_2=1$, the step 1007 terminates without executing further steps.

If $K_2<1$ in the step 502, a step 503 takes place in which the value of $K_3^n$ is decreased by $\Delta K_3$ and then the result of the decrease will be temporarily stored. On the other hand, if $K_2>1$ in the step 502, a step 504 takes place to increase the value of $K_3^n$, which has been obtained in the prior cycle, by $\Delta K_3$, and then the result of the increase will be temporarily stored before a step 505 takes place.

In the step 505, it is detected whether the intake air quantity subrange number "n" indicates that the intake air quantity is in a midrange at this time. In detail, it is detected if $3 \leqq n \leqq 14$. If the answer of the step 505 is NO, i.e. when the intake air quantity Q is out of the midrange, a step 510 takes place to store a value of $K_3^n$ obtained in the prior cycle in the RAM 107. On the other hand, when it is detected that the intake air quantity Q is in the midrange, a step 506 takes place in which typical correction factors $K_A$ and $K_B$ respectively corresponding to small quantity and large quantity of the intake air will be obtained by using the aforementioned formulas (1) and (2). Then in a following step 507, a limit value $K_L$ for the midrange intake air quantity will be obtained by using the aforementioned formula (3). In a following step 508, it is detected whether the value of $K_3^n$, which has been obtained in the step 507, is greater than or equal to the limit value $K_L$. If $K_3^n$ is greater than or equal to $K_L$, the value of $K_3^n$ will be stored in the RAM 107 as it is. On the other hand, if $K_3^n$ is smaller than $K_L$, the value of $K_3^n$ will be rewritten to the limit value $K_L$ before $K_3^n$ is stored in the RAM 107 in the step 510.

Although the above-described method is satisfactory when the values of the typical correction factors $K_A$ and $K_B$ for small and large intake air quantities are close to each other, the accuracy in air/fuel ratio control will be lowered when $K_A$ and $K_B$ are much different from each other.

Figure 10A:
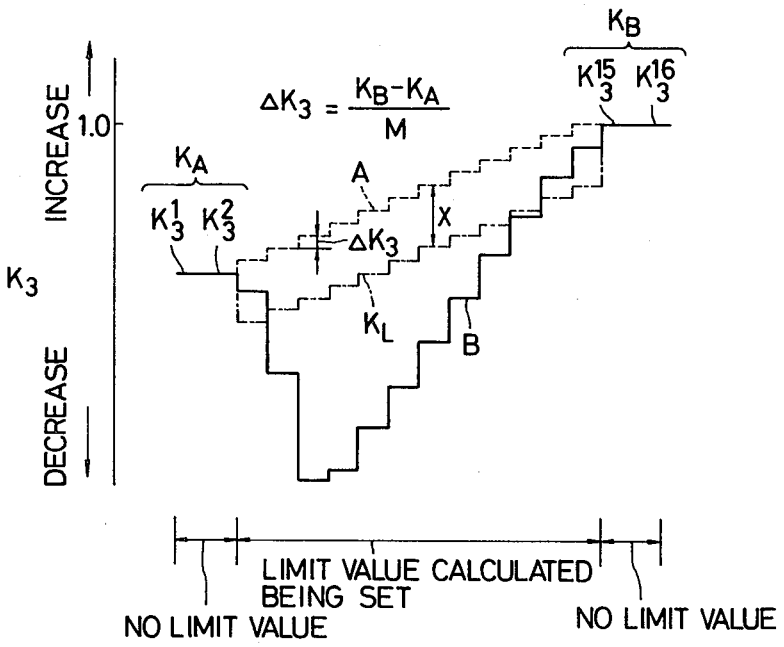

Another calcuating method for increasing the control accuracy which does not suffer from this problem will be described with reference to FIGS. 10 and 11. At the beginning typical third correction factors $K_A$ and $K_B$ are obtained in the same manner as described with reference to FIG. 9A. It is assumed that the number of intake air subranges in the midrange, at which a limit value will be set, is expressed in terms of M. Suppose that a limit value for the third subrange is expressed by $K_L$, the value of $K_L$ will be obtained by the folowing formula (4):

$$K_L^3 = K_A + (K_B - K_A)/M - X \quad (4)$$

Let $(K_B - K_A)/M$ be replaced by $\Delta K_3$, then Eq. (4) will be rewritten as:

$$K_L^3 = K_A + \Delta K_3 - X$$

Nextly, a limit value $K_L^4$ for the fourth intake air quantity subrange will be given by:

$$K_L^4 = K_A + \Delta K_3 X2 - X$$

In this way, the value of the limit value increases by $\Delta K_3$ as the subrange No. increases one by one.

Accordingly, the limit value $K_L$ will be generally expressed by:

$$K_L^n = K_A + \Delta K_3 X(n-2) - X \quad (5)$$

wherein "n" is an intake air quantity subrange No.; and $$\Delta K_3 = (K_A - K_B)/M$$

Figure 10B:
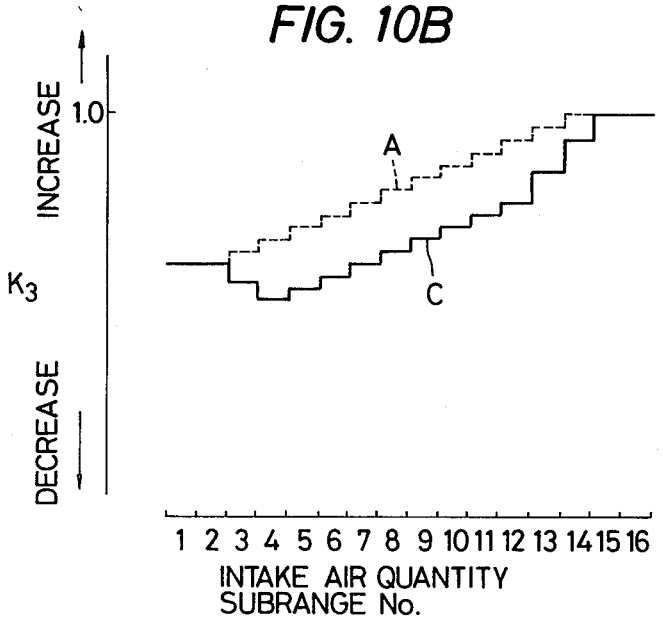

As a result of setting of the limit vlaue $K_L$, the value of the third correction factor $K_3$ varies as indicated by a solid line (B) in FIG. 10B. From the above, it will be understood that the undesirable influence due to fuel vapor from the canister 40 can be minimized even if the difference betweeen $K_A$ and $K_B$ is relatively great.

Figure 11:
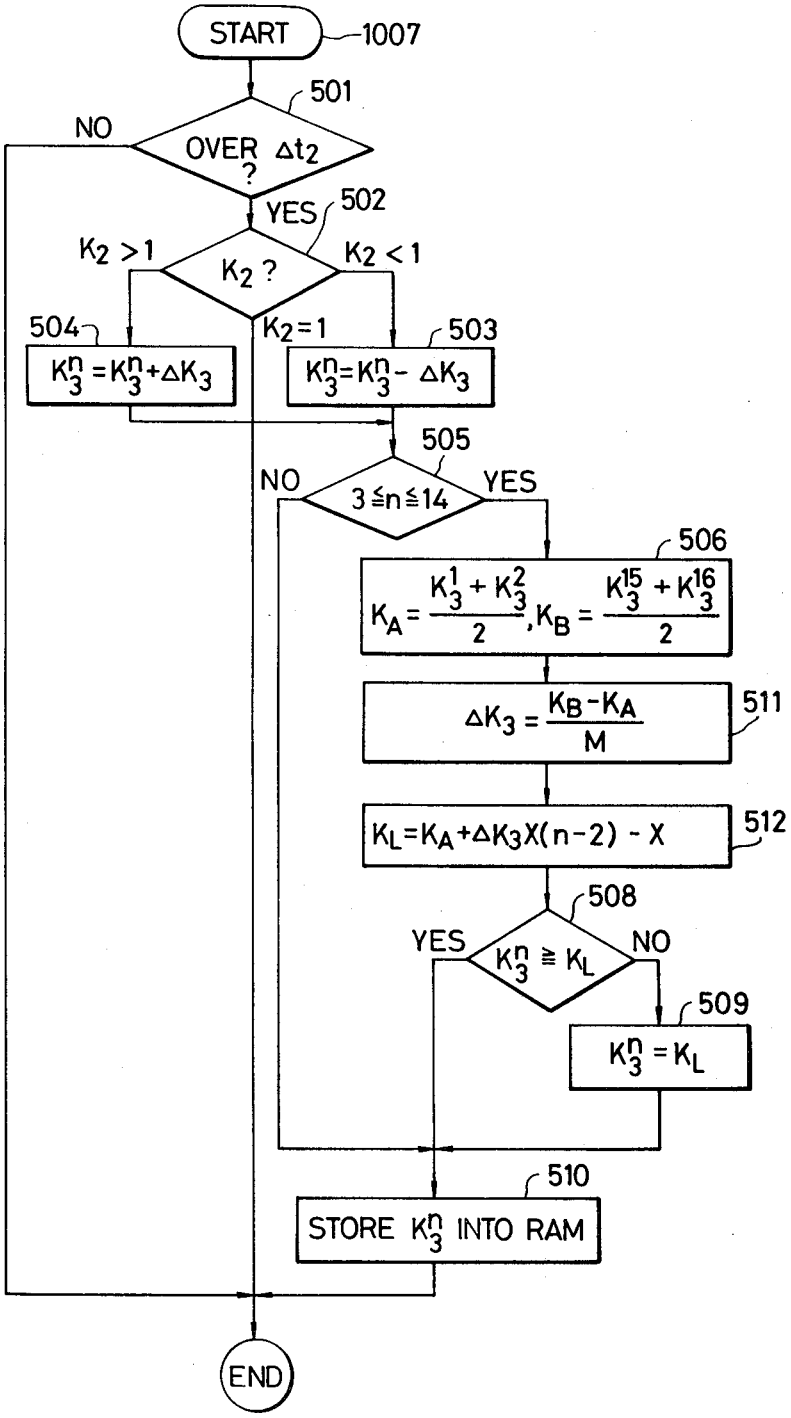
FIG. 11 is a flowchart of another example of the step for processing the third correction factor shown in FIG. 3.

FIG. 11 shows a flowchart for obtaining the third correction factors $K_3$ by using the above-described method. The flowchart of FIG. 11 only differs from that of FIG. 5 in that the step 507 of FIG. 5 is replaced by steps 511 and 512 in which operations described in the above are performed, and therefore, description of the flowchart of FIG. 11 is omitted.

In the above described embodiments, although the limit value $K_L$ has been obtained in relation to an engine operational condition, such as the intake air quanity, the limit value may be set for the third correction factor $K_3$ irrespective of the engine operational condition. For instance, a constant limit value may be set irrespective of the intake air quantity. Furthermore, various different limit values may be set respectively for different subranges of the intake air quantity.

The above-described embodiments are just examples of the present invention, and therefore, it will be apparent for those skilled in the art that many modifications and variations may be made without departing from the spirit of the present invention.

What is claimed is:

1. A method for controlling air/fuel ratio in an internal combustion engine equipped with a closed loop control system which controls the air/fuel ratio in accordance with an output signal of a sensor detecting the air/fuel ratio, comprising the steps of:

(a) integrating said output signal from said sensor for obtaining an integration correction factor;

(b) detecting the operational condition of said engine;

(c) renewing an engine condition correction factor read out from a memory, in which a plurality of engine condition correction factors are prestored, by using said integration correction factor where one of said engine condition correction factors corresponding to the operational condition of said engine is renewed;

(d) limiting the value of said engine condition correction factors so as not to exceed a predetermined value, which is variable in relation to the engine operational conditions; and (e) controlling the air/fuel ratio by correcting a standard value, which is obtained on the basis of the operational parameters of said engine, by said integration correction factor and said engine condition correction factor selectively read out from said memory in accordance with the engine operational condition.

2. A method as claimed in claim 1, wherein the quantity of intake air of said engine is used as said engine operational condition.

3. A method as claimed in claim 1, further comrising a step of obtaining said predetermined value on the basis of an engine condition correction factor for a predetermined engine operational condition and another engine condition correction factor for another predetermined engine operational condition.

4. A method as claimed in claim 1, further comrising a step of obtaining said predetermined value on the basis of a value of said engine condition correction factor for a predetermined engine operational condition and another value of said engine condition correction factor for another predetermined engine operational condition.

5. A method as claimed in claim 3 or 4, wherein said predetermined engine operational condition and said another predetermined engine operational condition are a condition in which the intake air quantity is small and a condition in which the intake air quantity is large.

6. A method as claimed in claim 1, further comprising a step of obtaining said predetermined value for each of a plurality of subranges, which are provided by dividing the entire range of the intake air quantity of said engine, on the basis of a value of said engine condition correction factor for small intake air quantity and another value of said engine condition correction factor for large intake air quantity.

7. A method as claimed in claim 1, wherein the combination of the step of renewing and the step of limiting comprises the steps of:

(a) detecting whether time has lapsed over a predetermined period of time;

(b) detecting the value of said integration correction factor to see if the value is either greater than 1 or smaller than 1, or equal to 1;

(c) renewing said engine condition correction factor by either increasing the value of said engine condition correction factor by a predetermined amount when said integration correction factor is greater than 1, or decreasing the value by said predetermined amount when said integration correction factor is smaller than 1;

(d) detecting whether the intake air quantity is in a predetermined midrange;

(e) calculating first and second typical engine condition correction factors respectively corresponding to small intake air quantity and large intake air quantity, which are out of said predetermined midrange, by averaging at least two engine condition correction factors for each of said small and large intake air quantities;

(f) calculating a limit value by subtracting a predetermined value from a mean value of said first and second typical engine correction factors;

(g) detecting whether said engine condition correction factor, which has been renewed, is greater than said limit value;

(h) setting said renewed engine condition correction factor to said limit value when said renewed engine condition correction factor is smaller than said limit value; and (i) storing the renewed but not limited engine condition correction factor into said memory when said intake air quantity is out of said predetermined range, when said engine condition correction factor is either greater or equal to said limit value, or storing the limited engine condition correction factor when said engine condition correction factor has been limited.

8. A method as claimed in Claim 1, wherein the combination of the step of renewing and the step of limiting comprises the steps of:

(a) detecting whether time has lapsed over a predetermined period of time;

(b) detecting the value of said integration correction factor to see if the value is either greater than 1 or smaller than 1, or equal to 1;

(c) renewing said engine condition correction factor by either increasing the value of said engine condition correction factor by a predetermined amount when said integration correction factor is greater than 1, or decreasing the value by said predetermined amount when said integration correction factor is smaller than 1;

(d) detecting whether the intake air quantity is in a predetermined midrange;

(e) calculating first and second typical engine condition correction factors respectively corresponding to small intake air quantity and large intake air quantity, which are out of said predetermined midrange, by averaging at least two engine condition correction factors for each of said small and large intake air quantities;

(f) calculating a quotient by dividing the difference between said first and second typical engine condition correction factors by the number of subranges provided in said predetermined midrange to set said predetermined amount to said quotient;

(g) calculating a limit value by using a formula of;

$$K_L = K_A + \Delta K_3 X(n-2) - X$$

wherein $K_L$ is said limit value;

$K_A$ is said first typical engine condition correcting factor;

$\Delta K_3$ is said predetermined amount;

n is a number of said subrange, where said subranges are numbered as 1, 2, 3 . . . from the smallest intake air quantity subrange; and X is a constant;

(h) detecting whether said engine condition correction factor, which has been renewed, is greater than said limit value;

(i) setting said renewed engine condition correction factor to said limit value when said renewed engine condition correction factor is smaller than said limit value; and (j) storing the renewed but not limited engine condition correction factor into said memory when said intake air quantity is out of said predetermined range, when said engine condition correction factor is either greater or equal to said limit value, or storing the limited engine condition correction factor when said engine condition correction factor has been limited.

9. Apparatus for controlling air/fuel ratio in an internal combustion engine equipped with a closed loop control system which controls the air/fuel ratio in accordance with an output signal of a sensor detecting the air/fuel ratio, comprising:

(a) first means for detecting the operational condition of said engine; and (b) second means for processing said output signal from said sensor for obtaining a correction factor;

for renewing an engine condition correction factor read out from a memory, in which a plurality of engine condition correction factors are prestored, by using said first-mentioned correction factor where one of said engine condition correction factors correspdoning to the operational condition of said engine is renewed;

for limiting the value of said engine condition correction factors so as not to exceed a predetermined value which is variable in relation to the engine operational conditions;

for calculating a standard value for a basic air/fuel ratio on the basis of the operational parameters of said engine;

for correcting said standard value by both said first-mentioned correction factor and said engine condition correction factor selectively read out from said memory in accordance with the engine operational condition; and for controlling the air/fuel ratio in accordance with data corresponding to the corrected standard value.

10. Apparatus as claimed in claim 9, wherein said first means comprises an airflow meter which detects the intake air quantity of said engine.

11. Apparatus as claimed in claim 9, wherein said second means includes a microcomputer.

12. Apparatus for controlling air/fuel ratio in an internal combustion engine, comprising:

(a) a ratio sensor for detecting the air/fuel ratio;

(b) engine sensor means for detecting the operational condition of said engine; and (c) computer means having a memory and being responsive to signals from said ratio sensor and said engine sensor means for performing operations, for computing a basic amount for defining the air/fuel ratio, for computing a correction factor, with which the air/fuel ratio will be corrected, in accordance with the signal from said ratio sensor to store the same in said memory, for finding an engine operational condition correction factor for correcting the air/fuel ratio to store the same in said memory, in location corresponding to the engine operational condition, and for limiting said engine condition correction factor so that it does not exceed a predetermined value which is variable in relation to the engine operational condition.

* * * * *